US008184111B2

(12) United States Patent
Kong et al.

(10) Patent No.: US 8,184,111 B2
(45) Date of Patent: May 22, 2012

(54) DRIVER FOR A DISPLAY HAVING A FREQUENCY DETECTION UNIT

(75) Inventors: Seung Kon Kong, Gyunggi-do (KR); Byoung Own Min, Gyunggi-do (KR); Jung Chul Gong, Seoul (KR); Jeong In Cheon, Seoul (KR); Yu Jin Jang, Gyunggi-do (KR)

(73) Assignee: Samsung Electro-Mechanics Co., Ltd., Gyunggi-do (KR)

( * ) Notice: Subject to any disclaimer, the term of this patent is extended or adjusted under 35 U.S.C. 154(b) by 453 days.

(21) Appl. No.: 12/464,399

(22) Filed: May 12, 2009

(65) Prior Publication Data

US 2010/0134450 A1 Jun. 3, 2010

(30) Foreign Application Priority Data

Nov. 28, 2008 (KR) ..... 10-2008-0120027

(51) Int. Cl.
*G09G 5/00* (2006.01)

(52) U.S. Cl. ..... 345/204; 345/212; 345/213

(58) Field of Classification Search ..... 345/87–100, 345/204–215
See application file for complete search history.

(56) References Cited

U.S. PATENT DOCUMENTS

| | | | | |
|---|---|---|---|---|
| 6,515,436 | B2 * | 2/2003 | Kobayashi et al. | 315/307 |
| 2002/0011807 | A1 * | 1/2002 | Kobayashi et al. | 315/291 |
| 2005/0190171 | A1 * | 9/2005 | Jang et al. | 345/204 |
| 2006/0164366 | A1 | 7/2006 | Yu et al. | |

FOREIGN PATENT DOCUMENTS

| | | |
|---|---|---|
| JP | 06153122 | 5/1994 |
| JP | 09191416 | 7/1997 |
| JP | 11109908 | 4/1999 |
| JP | 2006098532 | 4/2006 |
| JP | 2007288526 | 11/2007 |

OTHER PUBLICATIONS

Japanese Office Action for Application No. 2009-119880 mailed Oct. 25, 2011.

* cited by examiner

*Primary Examiner* — Vijay Shankar
(74) *Attorney, Agent, or Firm* — Lowe, Hauptman, Ham & Berner, LLP

(57) ABSTRACT

A driver for display provides a driving signal having a frequency synchronized with that of an image signal when the image signal is normal and provides a driving signal having a predetermined frequency when the image signal is abnormal, thereby performing a stable operation. The driver includes a frequency detection unit detecting a frequency difference between a frequency of an inputted image signal and a frequency of a frequency-divided driving signal, a driving signal generation unit generating the driving signal having a frequency synchronized with the frequency of the image signal according to a detection result of the frequency detection unit, and a control unit stopping a frequency detection operation of the frequency detection unit when the detection result of the frequency detection unit shows an abnormal operation.

7 Claims, 3 Drawing Sheets

DRIVER FOR A DISPLAY HAVING A FREQUENCY DETECTION UNIT

CROSS-REFERENCE TO RELATED APPLICATIONS

This application claims the priority of Korean Patent Application No. 2008-0120027 filed on Nov. 28, 2008, in the Korean Intellectual Property Office, the disclosure of which is incorporated herein by reference.

BACKGROUND OF THE INVENTION

1. Field of the Invention

The present invention relates to a driver for display, and more particularly, to a driver for display, which can perform stable operations by providing a driving signal having a frequency synchronized with that of an image signal in a case where the image signal is normal and providing a driving signal having a predetermined frequency in a case where the image signal is abnormal, in a display device, particularly, a backlight unit driver used in the display device.

2. Description of the Related Art

Recently, due to the lightening, slimming and simplifying of electronic devices, a liquid crystal display (LCD) is mostly applied to various display devices such as a television.

Such an LCD product necessarily includes a backlight unit driver that lights the lamps of the LCD to output light.

A horizontal sync signal and a vertical sync signal used in an image board are applied to the LCD product. The above-described horizontal sync signal and vertical sync signal have different frequencies. The frequency of the horizontal sync signal and the frequency of the vertical sync signal cause interference between the frequency of a lamp driving signal and the frequency of a lamp brightness signal, and thus, a water fall or a flicker may appear.

As one of methods for preventing the water fall or the flicker from appearing, a method is generally used for synchronizing the frequency of the horizontal sync signal and the frequency of the lamp driving signal.

However, in a case where the horizontal sync signal is abnormal, the frequency of the lamp driving signal may be abnormal for being synchronized with the frequency of the horizontal sync signal, and consequently an abnormal operation may occur for the driving of the lamp.

SUMMARY OF THE INVENTION

An aspect of the present invention provides a driver for display, which provides a driving signal having a frequency synchronized with that of an image signal in a case where the image signal is normal, and provides a driving signal having a predetermined frequency in a case where the image signal is abnormal, thereby performing a stable operation in a display device, particularly, a backlight unit driver used in the display device.

According to an aspect of the present invention, there is provided a driver for display, including: a frequency detection unit detecting a frequency difference between a frequency of an inputted image signal and a frequency of a frequency-divided driving signal; a driving signal generation unit generating the driving signal having a frequency synchronized with the frequency of the image signal according to a detection result of the frequency detection unit; and a control unit stopping a frequency detection operation of the frequency detection unit when the detection result of the frequency detection unit shows an abnormal operation.

According to another aspect of the present invention, the driving signal generation unit may synchronize the frequency of the driving signal with the frequency of the image signal when the detection result of the frequency detection unit shows a normal operation, and may determine the frequency of the driving signal as a predetermined frequency when the detection result of the frequency detection unit shows the abnormal operation.

According to another aspect of the present invention, the control unit may include: an initialization unit readying a control operation of the control unit when the image signal is inputted; a comparison unit comparing whether a voltage level of the detection result is within a predetermined voltage-level range; and a synchronization control unit resetting the frequency detection unit to stop a synchronization operation of the driving signal generation unit when a comparison result of the comparison unit shows an abnormal operation.

According to another aspect of the present invention, the initialization unit may include at least one logic circuit receiving the image signal and a predetermined high-level signal to output an operation ready signal for readying a control operation.

According to another aspect of the present invention, the synchronization control unit may include: a first logic circuit performing a logic operation on a clock signal having a predetermined period and the operation ready signal to output a control start signal for informing control start; a second logic circuit performing a logic operation on an abnormal operation signal for informing the abnormal operation, the control start signal and an inverted clock signal to output an abnormal operation result signal; a third logic circuit performing a logic operation on the abnormal operation result signal, the control start signal and the clock signal to output a reset signal for resetting the second logic circuit; a first AND gate performing an AND operation on the reset signal and a comparison result of the comparison unit to transfer a result of the AND operation to the second logic circuit; and a second AND gate performing an AND operation on the operation ready signal and an inverted reset signal to output an operation control signal for stopping or restarting a charge/discharge control operation of the frequency detection unit.

According to another aspect of the present invention, the synchronization control unit may further include: a first inverter inverting the clock signal and transferring the inverted clock signal to the second logic circuit; and a second inverter re-inverting the inverted clock signal from the first inverter to transfer the clock signal to the third logic circuit.

According to another aspect of the present invention, the driving signal generation unit may include: a charge pump charging or discharging a predetermined current to set a reference voltage according to a charge/discharge control of the frequency detection unit; a voltage control oscillator generating the driving signal having a frequency which is determined according to the reference voltage from the charge pump; and a divider frequency-dividing the driving signal from the voltage control oscillator according to a predetermined frequency-division ratio to feed back the frequency-divided driving signal to the frequency detection unit.

According to another aspect of the present invention, the driving signal generation unit may further include an RC oscillation circuit setting a frequency of the driving signal when an operation of the frequency detection unit is stopped by the control unit.

BRIEF DESCRIPTION OF THE DRAWINGS

The above and other aspects, features and other advantages of the present invention will be more clearly understood from the following detailed description taken in conjunction with the accompanying drawings, in which.

DETAILED DESCRIPTION OF THE PREFERRED EMBODIMENT

Exemplary embodiments of the present invention will now be described in detail with reference to the accompanying drawings.

Figure 1:
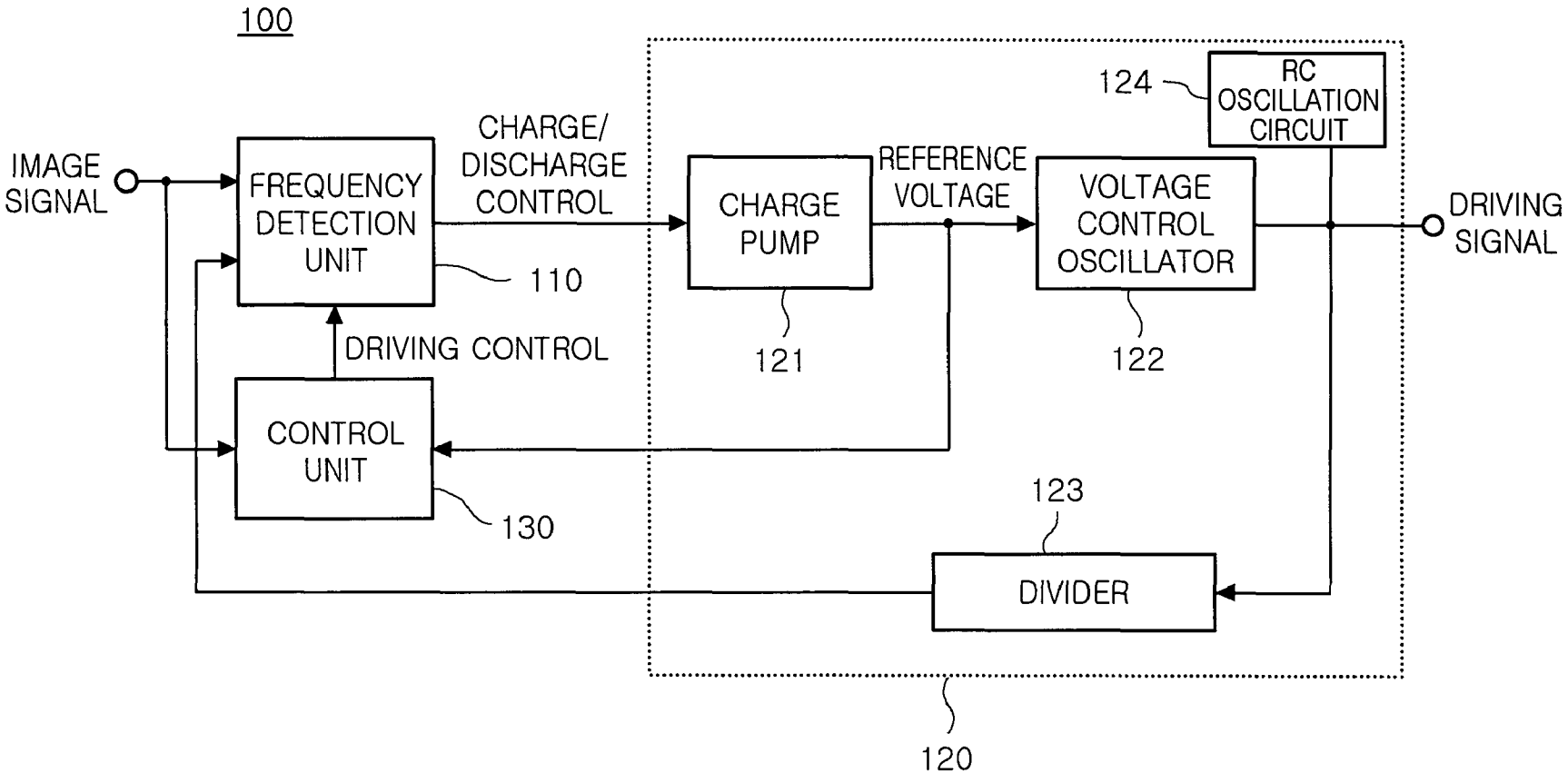
FIG. 1 is a schematic block diagram of a driver for display according to an embodiment of the present invention.

FIG. 1 is a schematic block diagram of a driver for display according to an embodiment of the present invention.

Referring to FIG. 1, the driver 100 for display according to an embodiment of the present invention may include a frequency detection unit 110, a driving signal generation unit 120, and a control unit 130.

The frequency detection unit 110 detects the frequency difference between an image signal inputted from an external image board and a frequency-divided driving signal.

The driving signal generation unit 120 generates the driving signal having a frequency which is determined according to the detection result.

The driving signal generation unit 120 may include a charge pump 121, a voltage control oscillator 122, a divider 123, and an RC oscillation circuit 124.

The charge pump 121 charges/discharges a predetermined current according to the detection result of the frequency detector 110 to provide a reference voltage.

The voltage control oscillator 122 generates the driving signal having a frequency which is determined according to the reference voltage from the charge pump 121.

The divider 123 frequency-divides the driving signal from the voltage control oscillator 122 according to a predetermined frequency-division ratio to transfer the frequency-divided signal to the frequency detection unit 110.

The RC oscillation circuit 124 may include a resistor and a capacitor, and forms a frequency by the oscillation between the resistor and the capacitor. The formed frequency is used for the frequency of the driving signal. That is, the voltage control oscillator 122 generates the driving signal having a frequency varying with the reference voltage from the charge pump 121 to generate a driving signal synchronized with the frequency of the image signal. At this point, when abnormalness occurs in the image signal, the voltage control oscillator 122 generates a driving signal having a frequency which is set by the RC oscillation circuit 124.

Determining whether the image signal is abnormal is performed in the control unit 130.

The control unit 130 determines whether the image signal is abnormal to control the frequency synchronization operation of the voltage control oscillator 122.

Accordingly, the control unit 130 receives the reference voltage from the charge pump 121, and compares whether the voltage level of the received reference voltage is within a predetermined voltage range. When the voltage level of the received reference voltage is within the predetermined voltage range, the control unit 130 determines that an inputted image signal is normal. When the voltage level of the received reference voltage is not within the predetermined voltage range, the control unit 130 determines that the inputted image signal is abnormal.

When the inputted image signal is determined to be abnormal, the control unit 130 stops the operation of the frequency detection unit 110 to stop the frequency synchronization operation of the voltage control oscillator 122.

That is, when the control unit 130 stops the frequency detection operation of the frequency detection unit 110, the charge pump 121 cannot provide the reference voltage to the voltage control oscillator 122, and consequently the voltage control oscillator 122 generates the driving signal having a frequency which is set by the RF oscillation circuit 124.

Accordingly, the control unit 130 restarts or stops the frequency synchronization operation according to whether the image signal is abnormal, thereby preventing an abnormal operation in driving the lamp.

The following description will be made with reference to the accompanying drawings on the detailed configuration and operation of the control unit.

Figure 2:
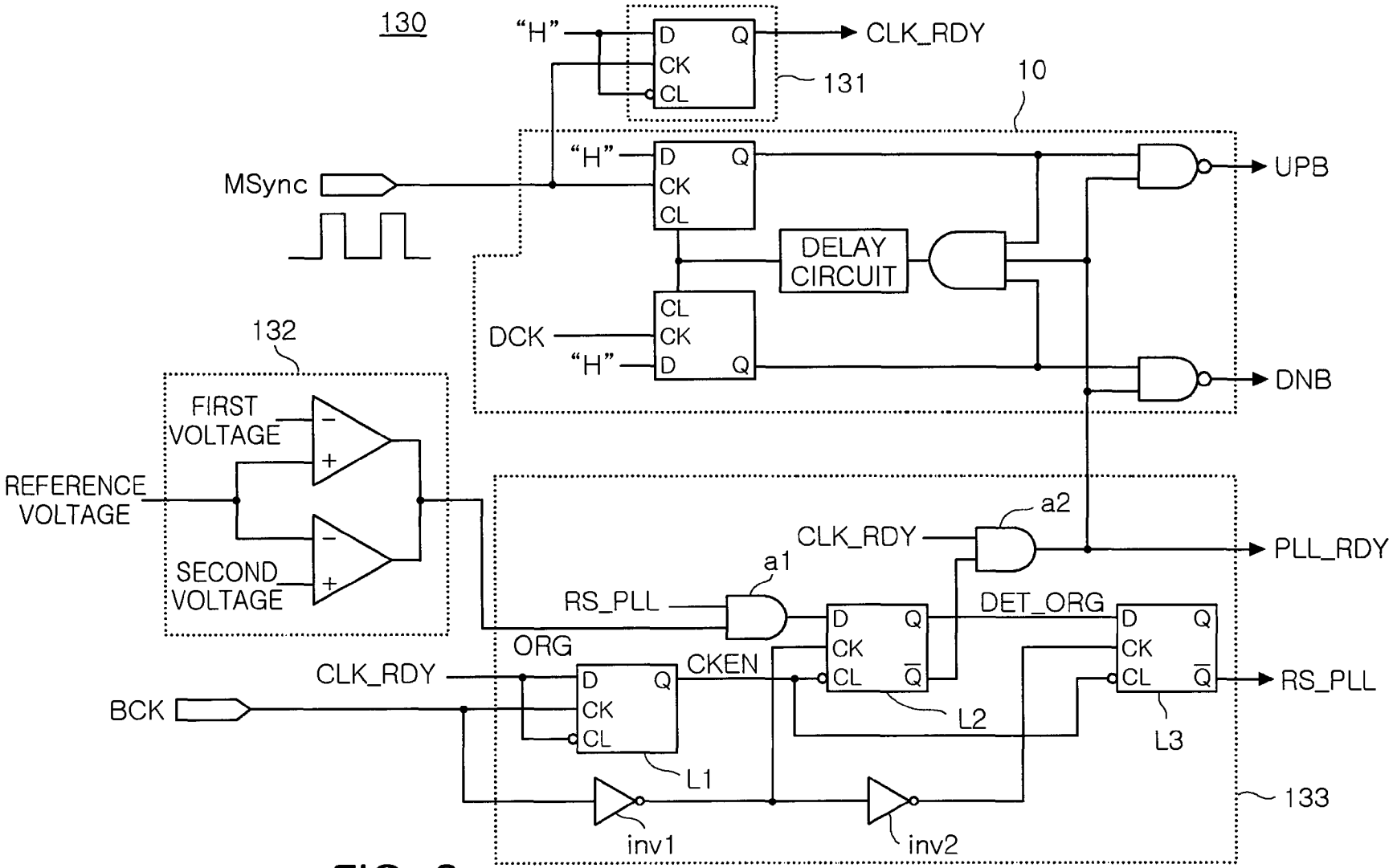
FIG. 2 is a detailed block diagram of a control unit applied to the driver for display according to an embodiment of the present invention.
Figure 3:
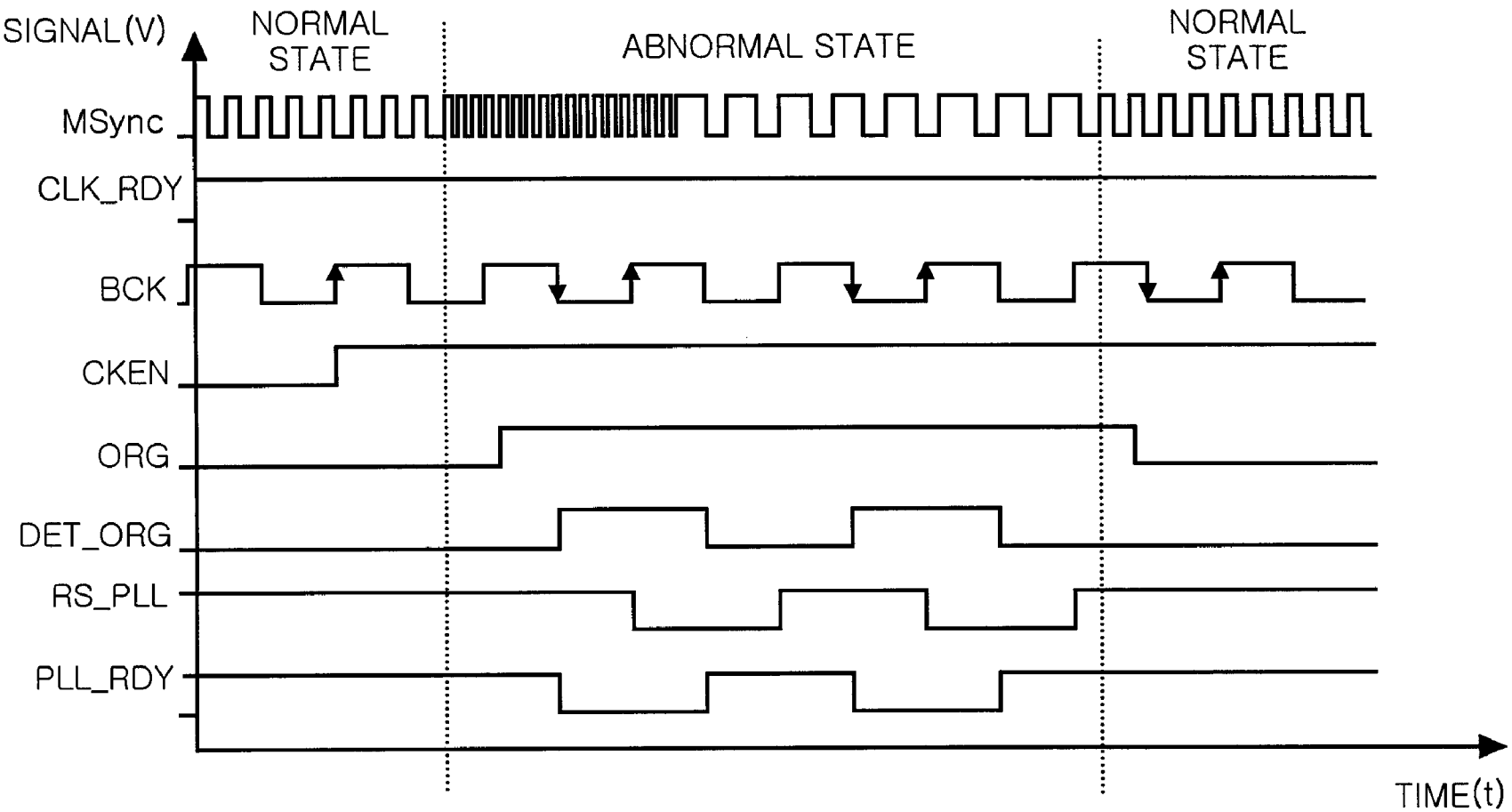
FIG. 3 is a timing diagram of each signal used in the driver for display according to an embodiment of the present invention.

FIG. 2 is a detailed block diagram of the control unit applied to the driver for display according to an embodiment of the present invention. FIG. 3 is a timing diagram of each signal used in the driver for display according to an embodiment of the present invention.

Referring to FIGS. 2 and 3, the control unit 130 according to an embodiment of the present invention may include an initialization unit 131, a comparison unit 132, and a synchronization control unit 133.

The initialization unit 131 may be configured with at least one logic circuit. The logic circuit have a CK terminal receiving an image signal MSync, a D terminal receiving a predetermined high-level signal H, a CL terminal receiving the predetermined high-level signal H, and a Q terminal outputting an operation ready signal CLK_RDY for readying a control operation. Herein, the initialization unit 131 performs a logic operation on the image signal MSync and the high-level signal H to output the operation ready signal CLK_RDY through the Q terminal.

As shown in FIG. 3, when the image signal MSync is inputted, the initialization unit 131 performs a logic operation on the image signal MSync and the high-level signal H to transfer the operation ready signal CLK_RDY of a high level to the synchronization control unit 133.

The comparison unit 132 includes at least two comparators. The at least two comparators receive a first voltage having a predetermined voltage level and a second voltage having a voltage level higher than the voltage level of the first voltage, respectively. The reference voltage from the charge pump 121 is applied to the respective comparators. Accordingly, the comparison unit 132 compares whether the voltage level of the reference voltage is between the voltage levels of the first and second voltages to determine whether the image signal MSync is abnormal.

That is, when the voltage level of the reference voltage is between the voltage levels of the first and second voltages, the comparison unit 132 determines to be a normal state, and transfers an abnormal operation signal ORG of a low level, informing that the image signal MSync is in a normal state, to the synchronization control unit 133. When the voltage level of the reference voltage is not between the voltage levels of the first and second voltages, the comparison unit 132 determines to be an abnormal state, and transfers the abnormal operation signal ORG of a high level, informing that the image signal MSync is in an abnormal state, to the synchronization control unit 133.

The synchronization unit 133 includes first to third logic circuits L1 to L3, first and second AND gates a1 and a2, and first and second inverters inv1 and inv2.

The logic circuit L1 includes a CK terminal receiving a clock signal BCK having a predetermined period, a D terminal receiving an operation ready signal CLK_RDY from the initialization unit 131, a CL terminal receiving the operation ready signal CLK_RDY from the initialization unit 131, and a Q terminal outputting a control start signal CKEN for informing control start. The logic circuit L1 performs a logic operation on the clock signal BCK and the operation ready signal CLK_RDY to output the control start signal CKEN to the second and third logic circuits L2 and L3 through the Q terminal.

The clock signal BCK has a predetermined period, and the control operations of the logic circuits L2 and L3 may become faster or slower according to the period of the clock signal BCK.

The second logic circuit L2 includes a D terminal receiving the result of the AND operation from the first AND gate a1, a CK terminal receiving a clock signal BCK inverted through the first inverter inv1, a CL terminal receiving a control start signal CKEN from the first logic circuit L1, a Q terminal outputting an abnormal operation result signal DET_ORG to the third logic circuit L3, and a Q' terminal outputting an inverted signal form of the abnormal operation result signal DET_ORG to the second AND gate a2. Herein, the second logic circuit L2 performs a logic operation on the result of the AND operation from the first AND gate a1, an inverted signal form of the clock signal BCK and the control start signal CKEN to transfer the abnormal operation result signal DET_ORG to the third logic circuit L3 through the Q terminal.

That is, the second logic circuit L2 detects the abnormalness of the image signal at the falling edge of the clock signal BCK to transfer the abnormal operation result signal DET_ORG to the third logic circuit L3, and transfers an inverted signal form of the abnormal operation result signal DET_ORG to the second AND gate a2.

The second AND gate a2 performs an AND operation on the inverted abnormal operation result signal DET_ORG and the operation ready signal CLK_RDY to output an operation control signal PLL_RDY for stopping or restarting the charge/discharge controlling of the frequency detection unit 110.

The operation control signal PLL_RDY from the second AND gate a2 is transferred to a plurality of logic AND devices of the frequency detection unit 110 which outputs a charge/discharge control signal for controlling the charge/discharge of the charge pump 121, respectively. When the operation control signal PLL_RDY has a low level, the charge/discharge controlling of the charge pump 121 is stopped. When the operation control signal PLL_RDY has a high level, the charge/discharge controlling of the charge pump 121 is performed.

The third logic circuit L3 includes a D terminal receiving the abnormal operation result signal DET_ORG from the second logic circuit L2, a CK terminal receiving a clock signal BCK re-inverted through the second inverter inv2, a CL terminal receiving a control start signal CKEN from the first logic circuit L1, and a Q' terminal outputting a reset signal RS_PLL for resetting the operation of the frequency detection unit 110 to the first AND gate a1. Herein, the third logic circuit L3 performs a logic operation on the abnormal operation signal DET_ORG, the clock signal BCK and the control start signal CKEN to output the reset signal RS_PLL to the first AND gate a1 through the Q' terminal.

The first AND gate a1 performs an AND operation on the reset signal RS_PLL and an abnormal signal ORG to transfer the result of the AND operation to the second logic circuit L2.

The third logic circuit L3 detects the abnormalness of the image signal at the rising edge of the clock signal BCK to transfer the reset signal RS_PLL to the first AND gate a1, and the result of the AND operation of the first AND gate a1 is transferred to the second logic circuit L2 to reset its operation.

Accordingly, when the image signal MSync is in an abnormal state, the operation control signal PLL_RDY stops the charge/discharge control operation of the frequency detection unit 110 at the first falling edge of the clock signal BCK, and thus, allows the driving signal from the voltage control oscillator 122 to have a frequency set by the RC oscillation circuit 124. At this point, the operation control signal PLL_RDY is reset at the first rising edge of the clock signal BCK to restart the charge/discharge control operation of the frequency detection unit 110 at the second falling edge of the clock signal BCK. Furthermore, the above-described operations are repetitively performed while the image signal MSync is in the abnormal state.

As described above, when the image signal MSync is in an abnormal state where its frequency is not within a normal frequency range or is fast or slow, the driver 100 stops the frequency synchronization operation, allows the driving signal to have a predetermined frequency, and stops and restarts the frequency synchronization operation until the image signal MSync is in a normal state, thereby protecting a driving circuit for display.

Embodiments of the present invention provide the driving signal synchronized with the image signal in a case where the image signal is normal, and provide the driving signal having the predetermined frequency in a case where the image signal is abnormal, thereby performing a stable operation.

While the present invention has been shown and described in connection with the exemplary embodiments, it will be apparent to those skilled in the art that modifications and variations can be made without departing from the spirit and scope of the invention as defined by the appended claims.

What is claimed is:

1. A driver for a display, comprising:

a frequency detection unit configured to detect a frequency difference between a frequency of an inputted image signal and a frequency of a frequency-divided driving signal;

a driving signal generation unit configured to generate a driving signal having a frequency synchronized with the frequency of the image signal according to a detection result of the frequency detection unit; and a control unit configured to stop a frequency detection operation of the frequency detection unit when the detection result of the frequency detection unit indicates an abnormal operation, wherein the driving signal generation unit is configured to synchronize the frequency of the driving signal with the frequency of the image signal when the detection result of the frequency detection unit indicates a normal operation, and sets the frequency of the driving signal to a predetermined frequency when the detection result of the frequency detection unit indicates the abnormal operation.

2. The driver of claim 1, wherein the control unit comprises:

an initialization unit configured to ready a control operation of the control unit when the image signal is inputted;

a comparison unit configured to compare whether a voltage level of the detection result is within a predetermined voltage-level range; and a synchronization control unit configured to reset the frequency detection unit to stop a synchronization operation of the driving signal generation unit when a comparison result of the comparison unit indicates the abnormal operation.

3. The driver of claim 2, wherein the initialization unit comprises at least one logic circuit configured to receive the image signal and a predetermined high-level signal and to output an operation ready signal for readying the control operation.

4. The driver of claim 3, wherein the synchronization control unit comprises:

a first logic circuit configured to perform a logic operation on a clock signal having a predetermined period and the operation ready signal to output a control start signal for informing control start;

a second logic circuit configured to perform a logic operation on an abnormal operation signal for informing the abnormal operation, the control start signal and an inverted clock signal to output an abnormal operation result signal;

a third logic circuit configured to perform a logic operation on the abnormal operation result signal, the control start signal and the clock signal to output a reset signal for resetting the second logic circuit;

a first AND gate configured to perform an AND operation on the reset signal and the comparison result of the comparison unit to transfer a result of the AND operation to the second logic circuit; and a second AND gate configured to perform an AND operation on the operation ready signal and an inverted reset signal to output an operation control signal for stopping or restarting a charge/discharge control operation of the frequency detection unit.

5. The driver of claim 4, wherein the synchronization control unit further comprises:

a first inverter configured to invert the clock signal and transfer the inverted clock signal to the second logic circuit; and a second inverter configured to re-invert the inverted clock signal from the first inverter to transfer the clock signal to the third logic circuit.

6. The driver of claim 5, wherein the driving signal generation unit comprises:

a charge pump configured to charge or discharge a predetermined current to set a reference voltage according to a charge/discharge control of the frequency detection unit;

a voltage control oscillator configured to generate the driving signal having a frequency which is determined according to the reference voltage from the charge pump; and a divider configured to frequency-divide the driving signal from the voltage control oscillator according to a predetermined frequency-division ratio to feed back the frequency-divided driving signal to the frequency detection unit.

7. The driver of claim 6, wherein the driving signal generation unit further comprises an RC oscillation circuit configured to set the frequency of the driving signal when an operation of the frequency detection unit is stopped by the control unit.

* * * * *